US005111527A

United States Patent [19]

Arold et al.

[11] Patent Number: 5,111,527

[45] Date of Patent: May 5, 1992

[54] ELECTRIC HEATER WITH THERMISTOR TEMPERATURE CONTROL

[75] Inventors: Johathan B. Arold, Exeter; Joan L. Mishou, Portsmouth; Charles R. Parent, Durham; Joseph P. Stark, New Market; Edward A. Webb, Wolfeboro, all of N.H.

[73] Assignee: GTE Products Corporation, Stamford, Conn.

[21] Appl. No.: 491,762

[22] Filed: Mar. 12, 1990

[51] Int. Cl.[5] ..... F24H 3/00

[52] U.S. Cl. ..... 392/360; 392/365; 392/379; 392/478; 392/476; 219/542

[58] Field of Search ..... 219/306, 307, 308, 364, 219/374, 375, 376, 379, 380, 381, 382, 501, 531, 546, 542, 441, 438; 361/366, 386, 388, 389; 363/141; 122/31.1; 392/341, 360, 482, 396, 398, 385, 476–478, 492, 473, 379, 365, 380, 382, 383, 384

[56] References Cited

U.S. PATENT DOCUMENTS

| | | | |
|---|---|---|---|
| 1,490,089 | 4/1924 | Bridges | 392/379 |
| 3,094,606 | 6/1963 | Ferris | 219/370 |
| 3,474,963 | 10/1969 | Buiting et al. | 392/360 |
| 3,551,643 | 12/1970 | Pricenski | 219/381 |
| 3,560,710 | 2/1971 | Fuellemann | 219/373 |
| 3,594,546 | 7/1971 | Smillie | 219/501 |
| 3,654,431 | 4/1972 | Brooks et al. | 219/373 |
| 3,783,236 | 1/1974 | Edin | 219/381 |
| 4,547,656 | 10/1985 | Swiatosz et al. | 392/397 |
| 4,660,510 | 4/1987 | Draper | 122/31.1 |
| 4,825,043 | 4/1989 | Knauss | 219/298 |

FOREIGN PATENT DOCUMENTS 120546 6/1985 Japan .

*Primary Examiner*—Bruce A. Reynolds
*Assistant Examiner*—Tu Hoang
*Attorney, Agent, or Firm*—James Theodosopoulos

[57] ABSTRACT

A forced gas electric heater has a serpentine heating element in series with a preheat coil. Gas to be heated first flows through the preheat coil before flowing through the serpentine heating element. A thermistor is disposed between two adjacent turns of the preheat coil. The thermistor controls the "on" time of a solid state power control device which is in series with the preheat coil and the serpentine heating element.

12 Claims, 2 Drawing Sheets

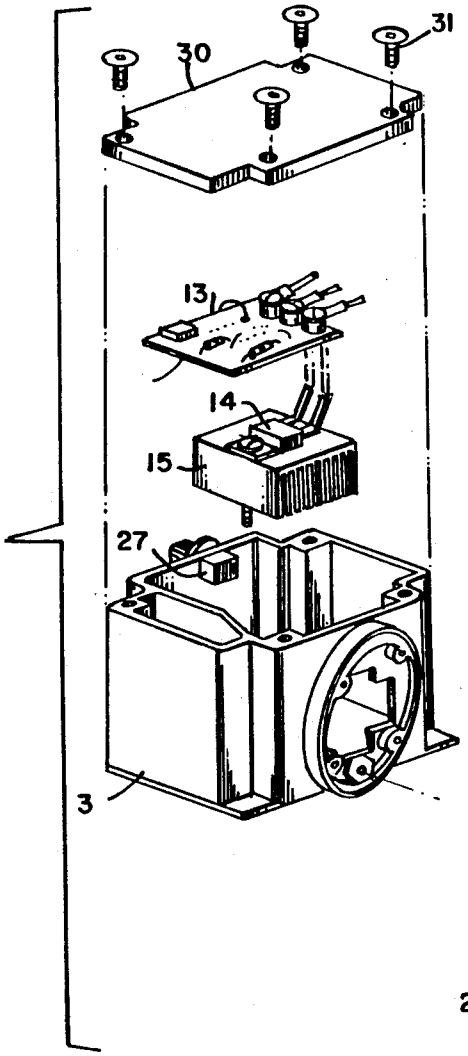
FIG. 3
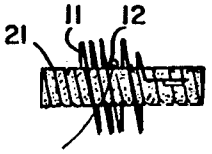
FIG. 4
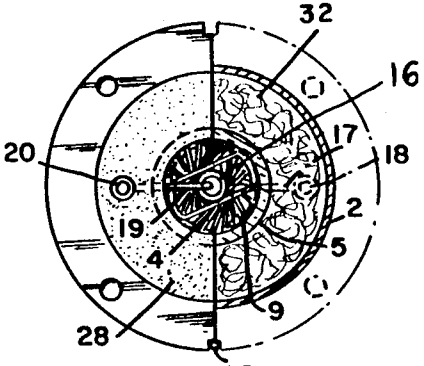
FIG. 5
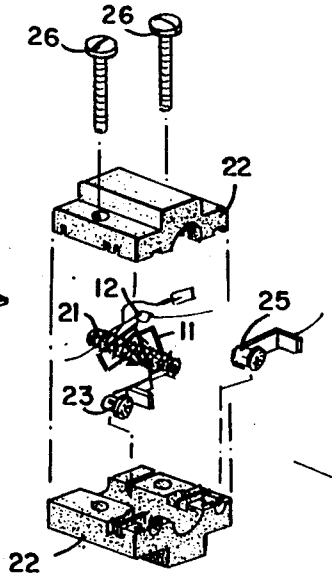
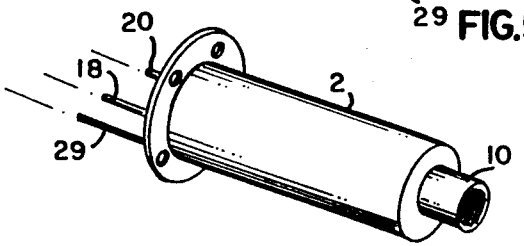

ELECTRIC HEATER WITH THERMISTOR TEMPERATURE CONTROL

BACKGROUND OF THE INVENTION

This invention concerns forced air or gas heaters. Examples thereof are shown in U.S. Pat. Nos. 3,783,236, 3,654,431, 3,551,643 and 3,094,606.

This invention provides a forced gas heater that prevents premature heater element burnout due to overheating.

A major problem with any process heat application involving forced air or gas heaters is premature heater element burnout. Heater elements oxidize with heat, the higher the temperature, the faster the oxidation, and if the heater element gets hotter still, it will melt. Premature burnout can occur if gas flow is too low and the heater element gets hotter than it should. In this invention a built-in controller keeps the heater element from burning out prematurely, even if gas flow is completely stopped.

Because premature burnout is a common problem with gas heater use, external controllers, which are sometimes expensive, have been used in the past. These controllers normally operate by measuring exit gas temperature from the heater, and, if the exit temperature is too great, the controller will cut power to the heater. This works, but it can take too long to react if the thermocouple used to measure the gas is to massive or if it was moved somehow from the exit of the heater. Also, if the gas flow is suddenly cut off, the thermocouple will read an increasingly lower temperature, because the hot gas will not pass over the junction. Therefore, the controller actually puts more power to the element, when, in fact, the element itself is too hot already. One way users have eliminated this problem is by adding yet another component to the controller.

By using a flow-sensor/switch or a pressure-sensor/-switch, the controller will cut power when there is an interruption or reduction in the gas flow. This must be used with the thermocouple temperature control to make the system work. It can fail easily, if there is too much pressure for the sensor/switch to take, for instance, if there is an unintentional burst of flow, the sensor may be pushed beyond its designed limits, and break. The user may also set these controllers to the wrong settings, and end up burning out the element because the controller was working, but within the wrong parameters.

Besides the added cost of all of this equipment to control, the space requirement often becomes a problem. Many users need to fit this equipment into small spaces, or into machines that they sell. There are heaters available that will control in a small space, but will not work when the gas flow is completely cut off.

SUMMARY OF THE INVENTION

A gas heater in accordance with this invention solves these problems. The gas heater is small and self-contained, without the need of external control devices and without the need of calibration. The gas heater keeps controlling even when there is no gas flow. Control is accomplished by means of a thermistor placed between two adjacent turns of a coiled heater winding, referred to as a preheat coil, at about the entrance end of the heater. Thus the thermistor is not subjected to the high temperatures in the central part of the coiled heater element or to the even higher temperatures at the exit end of the coiled heater element. The heater element used is that disclosed in U.S. Pat. No. 3,551,643, the disclosure of which is incorporated herein by reference. All or part of the gas flowing through the heater element flows through the preheat coil.

As disclosed in said patent, the heater element, hereinafter referred to as a serpentine heating element, comprises a length of coiled resistance wire, the individual turns of the coil having a substantially polygonal shape and being radially displaced from adjacent turns. As the temperature of the thermistor changes, its resistance changes. This resistance change can be used to vary the "on" time, that is to say, the high-current conducting state, of a solid state power control device, such as a silicon-controlled rectifier or a triac or a power transistor, which is in series with the serpentine heating element. Thus the power to the serpentine heating element can be controlled by the combination of the thermistor and the solid state power control device, thereby controlling the maximum temperature which the serpentine heating element can attain. Placing the thermistor between two adjacent turns of a heater winding places the thermistor in close heat transfer relationship therewith and makes the thermistor react faster to changes in the temperature of the heater winding than if the thermistor were located outside the turns or if the thermistor were located downstream from a heater winding and relied primarily on heat transfer by flowing gas. In the latter case, if gas flow were accidentally shut off, reaction time of the thermistor would be too slow to prevent the heater element from overheating.

BRIEF DESCRIPTION OF THE DRAWING

FIG. 1 is a perspective view of one example of a heater in accordance with this invention while FIGS. 2 and 3 are exploded perspective views.

FIG. 4 is a view of the thermistor and preheat coil.

FIG. 5 is an end view of the heater element portion of the electric heater.

DESCRIPTION OF THE PREFERRED EMBODIMENTS

Figure 1:
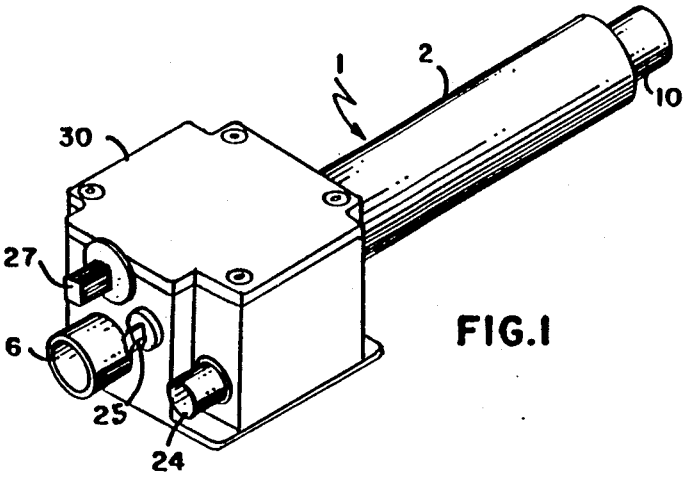
Figure 2:
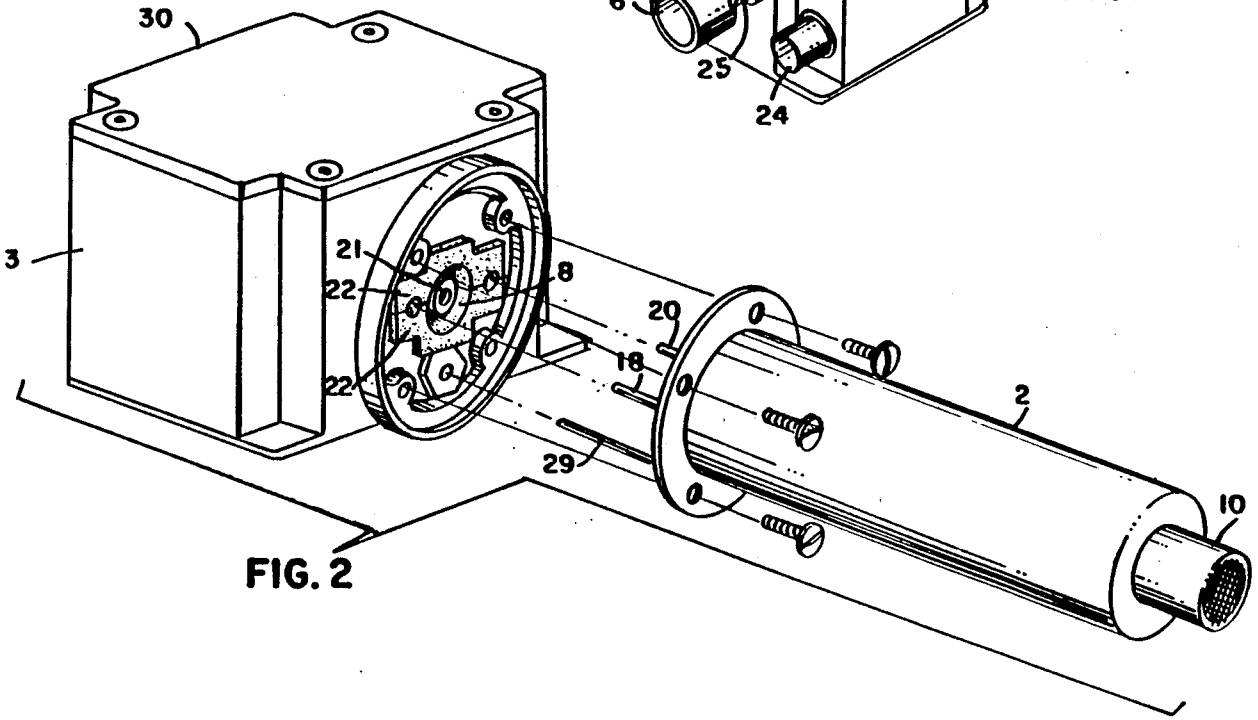

One example of a forced gas heater in accordance with this invention, as shown in the drawings, comprised a cylindrical metal shell 2 fastened to an enclosure 3 made of electrically insulative material. Enclosure 3 has a cover 30 fastened thereto by screws 31. A serpentine heating element 4 was disposed within a quartz or ceramic tube 5 within metal shell 2. Insulation 32 was disposed between quartz tube 5 and the cylindrical wall of metal shell 2. Forced gas, for example, air, would enter inlet 6 of enclosure 3, pass therethrough and out at exit 8, into inlet end 9 of metal shell 2, through serpentine heating element 4 and out at outlet 10. Disposed within the exit area of enclosure 3 was a short length of coiled heater winding, preheat coil 11, consisting of four or five turns of resistance wire. Preheat coil 11 was electrically in series with heating element 4. Disposed between two adjacent turns of preheat coil 11 was a thermistor 12, which was electrically connected to an electrical control circuit within enclosure 3, part of the electrical control circuit being mounted on printed circuit board 13. The electrical control circuit included a silicon-controlled rectifier 14, hereafter SCR, as the solid state power control device, which was mounted on heat sink 15. SCR 14 was electrically in series with preheat coil 11 and heating element 4. SCR 14 controlled the time during which heating current flowed through preheat coil 11 and heating element 4. The high-current conducting state of SCR 14 was dependent on the temperature of thermistor 12, and was such as to limit the maximum temperature which preheat coil 11 could attain. Since serpentine heating element 4 was in series with preheat coil 11, SCR 14 also limited the maximum temperature which serpentine heating element 4 could attain.

A ceramic cylinder 16 extended through the axis of serpentine heating element 4. A metal wire 17 extended through the axis of ceramic cylinder 16, the purpose of which was to provide electrical connection to the exit end of serpentine heating element 4. Wire 17 was connected to metal rod 18. The other end of serpentine heating element 4, the entry end, was connected to metal rod 20 by means of wire 19.

Preheat coil 11 was mounted on a threaded ceramic rod 21 and was disposed between two ceramic blocks 22 which fit within exit 8 of enclosure 3 and which were held together with bolts 26. Metal rod 18 was connected to the exit end of preheat coil 11 by means of electrical connector 23. Metal rod 18 passed through a hole in thick ceramic disk 28 which was disposed between exit 8 and serpentine heating element 4.

Electrical current flow was as follows. Electrical power was supplied through tube 24 by means of two lead-in wires (not shown). One lead-in wire was connected to the entry end of preheat coil 11. Current flowed from there through preheat coil 11, through electrical connector 23, through metal rod 18, through wire 17 to the exit end of serpentine heating element 4, through serpentine heating element 4 to wire 19, to electrical connector 25, through a wire (not shown) to SCR 14 and from there, through a wire (not shown), to the other lead-in wire entering tube 24. Thus SCR 14 was in series with preheat coil 11 and serpentine heating element 4.

Heat sink 15 was shaped and disposed so as to be cooled by the gas entering inlet 6. The purpose of heat sink 15 was to dissipate heat within enclosure 3. A gas damper 26 on enclosure 3 could be used to vary gas flow. A potentiometer 27 in the electrical control circuit could be used to vary the temperature of the gas exit outlet 10. Metal rod 29, which was electrically connected to metal shell 2, could be connected to ground of the power supply wires in order to ground metal shell 2.

For purposes of this invention, it is not necessary that preheat coil 11 be a winding separate from that of serpentine heating element 4. Preheat coil 11 could consist of the first few turns of serpentine heating element 4 with thermistor 12 disposed between two adjacent turns of said first few turns.

We claim:

1. A forced gas electric heater comprising: a serpentine heating element, a preheat coil electrically in series with the serpentine heating element, the preheat coil being disposed with respect to the serpentine heating element so that at least part of the gas being forced through the serpentine heating element in order to be heated thereby must first flow through the preheat coil, a thermistor disposed between two adjacent turns of the preheat coil so as to be in close heat transfer relationship therewith, a solid state power control device electrically in series with the preheat coil and the serpentine heating element, means for varying the high-current conducting state of the solid state power control device in accordance with variations in the temperature of the thermistor, means for introducing gas flow through the preheat coil and serpentine heating element, and means for introducing electrical power to the forced gas electric heater.

2. The electric heater of claim 1 wherein the serpentine heating element is disposed within a cylindrical shell and the solid state power control device is disposed within an enclosure, the cylindrical shell being fastened to the enclosure.

3. The electric heater of claim 2 wherein the enclosure has a gas inlet and an exit end, the relationship between the enclosure and the preheat coil being such that gas flowing through the enclosure passes through the preheat coil at about said exit end.

4. The electric heater of claim 3 wherein there is a heat sink within the enclosure which is cooled by gas flowing through the enclosure.

5. The electric heater of claim 4 wherein the solid state power control device is mounted on the heat sink.

6. The electric heater of claim 5 wherein the enclosure contains a potentiometer used to control outlet gas temperature.

7. The electric heater of claim 6 wherein the enclosure contains a gas damper.

8. The electric heater of claim 1 wherein the preheat coil consists of the first few turns of the serpentine heating element at the cooler end thereof.

9. The electric heater of claim 2 wherein the serpentine heating element is disposed within a quartz tube and wherein there is insulating material between the quartz tube and the wall of the cylindrical shell.

10. The electric heater of claim 2 wherein the electric heater contains means for grounding the cylindrical shell.

11. A forced gas electric heater comprising: a serpentine heating element, a preheat coil electrically in series with the serpentine heating element, the preheat coil being disposed with respect to the serpentine heating element so that gas being forced through the serpentine heating element in order to be heated thereby must first flow through the preheat coil, a thermistor disposed between two adjacent turns of the preheat coil so as to be in close heat transfer relationship therewith, a solid state power control device electrically in series with the preheat coil and the serpentine heating element, means for varying the high-current conducting state of the solid state power control device in accordance with variations in the temperature of the thermistor, means for introducing gas flow through the preheat coil and serpentine heating element, means for introducing electrical power to the forced gas electric heater, the serpentine heating element being disposed within a cylindrical shell, the solid state power control device being disposed within an enclosure, the cylindrical shell being fastened to the enclosure, the enclosure having a gas inlet and an exit end, the relationship between the enclosure and the preheat coil being such that gas flowing through the enclosure passes through the preheat coil at about said exit end, there being a heat sink within the enclosure which is cooled by gas flowing through the enclosure, the solid state power control device being mounted on the heat sink.

12. The electric heater of claim 11 wherein the serpentine heating element is disposed within a quartz or ceramic tube and wherein there is insulating material between the quartz or ceramic tube and the wall of the cylindrical shell.

* * * * *